United States Patent [19]

Satake et al.

[11] Patent Number: 4,849,396

[45] Date of Patent: Jul. 18, 1989

[54] HEAT-SENSITIVE RECORDING MATERIAL

[75] Inventors: Toshimi Satake; Toshiaki Minami; Tomoaki Nagai; Fumio Fujimura, all of Tokyo, Japan

[73] Assignee: Jujo Paper Co., Ltd., Tokyo, Japan

[21] Appl. No.: 53,961

[22] Filed: May 22, 1987

[30] Foreign Application Priority Data

Mar. 6, 1986 [JP] Japan ..... 61-128691

[51] Int. Cl.[4] ..... B41M 5/18

[52] U.S. Cl. ..... 503/210; 427/150; 503/211; 503/212; 503/216; 503/225

[58] Field of Search ..... 427/150–152; 503/210–212, 216, 225, 217; 428/913, 914

[56] References Cited

U.S. PATENT DOCUMENTS 3,795,532 3/1974 Newman et al. ..... 503/210
4,461,496 7/1984 Ludwig ..... 503/211

FOREIGN PATENT DOCUMENTS 1163890 7/1986 Japan ..... 503/212

*Primary Examiner*—Bruce H. Hess
*Attorney, Agent, or Firm*—Koda and Androlia

[57] ABSTRACT

A heat-sensitive recording material including a support and a color-developing layer having both an electron donor and a metal double salt or higher fatty acid having 16–35 carbon atoms as an electron acceptor. The heat-sensitive recording material is superior is dispersibility, image contrast, oil resistance, solvent resistance and optical readability in the near infrared region.

8 Claims, No Drawings

HEAT-SENSITIVE RECORDING MATERIAL

BACKGROUND OF THE INVENTION

1. Field of the Invention

This invention relates to a heat-sensitive recording material which is superior in dispersibility, image contrast, oil resistance, solvent resistance, and optical readability in the near infrared region.

2. Prior Art

A heat-sensitive recording sheet that utilizes a heat-color-forming reaction occuring between a colorless or pale-colored chromogenic dyestuff and a phenolic material, or an organic acid is disclosed, for example, in the Japanese Patent Publication Nos. 4160/1968 and 14039/1970 and in the Japanese Laid-Open Patent Publication No. 27736/1973, and is now widely applied for practical use.

In general, a heat-sensitive recording sheet is produced by applying on a support, such as paper, film etc., the coating which is prepared by individually grinding and dispersing a colorless chromogenic dyestuff and a color-developing material into fine particles, mixing the resultant dispersion with each other and then adding thereto binder, filler, sensitizer, slipping agent and other auxiliaries. The coating, when heated, undergoes instantaneously a chemical reaction which forms a color. In this case various bright colors may be formed depending upon the selection of colorless chromogenic dyestuff.

These heat-sensitive recording sheets have now been finding a wide range of applications, including medical or industrial measurement recording instruments, terminal printers of computer and information communication systems, facsimile equipments, printers of electronic calculators, automatic ticket vending machines, and so on.

In recent years, as the heat-sensitive recording systems are widely used and the applications of such recording are diversified, high image density is now required for the improvement of the resolution. The heat energy of the thermal head in the recording equipments capable of such high density is more minimized. Therefore, it is required that the heat-sensitive recording sheet has a higher color-forming sensitivity sufficient for producing clear chromogenic record with such small heat energy.

Meanwhile, the heat-sensitive recording sheets are inevitably touched with the hand of man, in view of their function as recording sheets of the information.

As the fingers of the operator are often adhered by solvents such as alcohols, acetones, etc., or by oily substances such as his hair tonic daily used and sebum, it may be said that the heat-sensitive recording sheets are most frequently contaminated by such substances. In general, the heat-sensitive recording sheets have insufficient stability against these oily substances and the solvents such as alcohols, acetones, etc., so that the density of the developed color image on the contaminated part is often reduced or disappeared. The contaminated white ground causes the phenomenon of discoloration or color forming. Their reasons can not be sufficiently elucidated yet, but it is supposed that such substances partly dissolve the coloring layer consisting of the fine granular basic colorless dyestuff and organic developer or coloring reactant thereof, or make the coloring layer or coloring reactant thereof instable.

Also, the developed images disappear, or the color reaction through the solvent between dyestuff and color-developing agent, i.e. the color development of the ground color, occurs.

In order to improve the oil resistance and solvent resistance, there have been proposed either a color-developing layer comprising a leuco dyestuff, an organic color-developing agent and organic acid metal salt; or a protective layer on a color-developing layer. The proposed methods do not yet provide a sufficient result.

Further, these heat sensitive recording sheets comprising the combination of a leuco-dyestuff and a color-developing agent are utilized as thermosensitive labels in POS-system. However, since the color formation is in the visible region, these recording sheets cannot be adapted for reading by a semi-conductor laser in the near infrared region which is used as a bar code scanner.

Besides the heat-sensitive color-developing system in which the above colorless leuco dyestuff is used, a chelate type color-developing system under the use of metal compounds is known.

For examples, the Japanese Patent Publication No. 8781/1957 describes the combined use of iron stearate (electron acceptor) with tannic acid or gallic acid, and the Japanese Patent Publication No. 6485/1959 describes the combined use of an electron acceptor such as silver stearate, iron stearate, gold stearate, copper stearate or mercury behenate with an electron donor such as methyl gallate, ethyl gallate, propyl gallate, butyl gallate or dodecyl gallate. Since these heat-sensitive system by means of the heat energy of light, they bring the troubles of accumulated residues and sticking under applying to heat-sensitive recording system which uses the thermal printing heads. In this case, they have as disadvantages a low image density, greenish color, poor brightness of the background, inferior stabiling against solvents such as alcohols, and the flowing-out of the color-developing layer. Further, Japanese Laid-Open Patent Application No. 89193/1984 describes a combination of a color-developing system using a leuco dyestuff and a color-developing agent and of a color-developing system using a metal compound of higher fatty acid ferric salt and polyvalent phenol. However, such combination is disadvantageous in costs, since it requires a protecting layer for hiding colored parts. Further, it has a defect that solvents such as alcohols are penetrated through the pin holes of a protecting layer, resulting in coloring (contamination) caused by a reaction between a leuco dyestuff and a color-developing agent which are present in a color-developing layer.

The inventors described in Japanese Laid-Open Patent Application No. 11681/1987 (Japanese Patent Application No. 150090/1985) that there was provided a heat-sensitive recording material which is suitable for a high speed recording and has a high stability of developed image against oily substances and solvents such as alcohols, by using the combination of a phenolic derivative and a higher fatty acid iron salt having 16–35 carbon atoms.

However, the higher fatty acid iron salt having 16–35 carbon atoms has the defects that fine foams are produced, the viscosity is increased and the coagulates are formed, in grinding to a particle size of several microns or smaller by means of a ball mill, attritor, sand grinder, etc.

Further, the above higher fatty acid iron salt itself has a poled yellow color, and hence the background of the heat-sensitive recording material obtained by applying the dispersed coating material is colored, which brings the defect of providing an inferior image contrast.

SUMMARY OF THE INVENTION

It is the object of this invention to provide a heat-sensitive recording material which is superior in dispersibility of coating color, image contrast, oil resistance, solvent resistance, optical readability in the near infrared region, among the heat-sensitive recording materials on the basis of chelate type color-forming system using metal compounds.

It is the another object of this invention to provide a heat-sensitive recording material which has stable image and ground color against oily substance such as hair oil, sebum, etc.

It is the further object of this invention to provide a heat-sensitive recording material which has better brightness of the background, and no flowing out of the color-developing layer.

The above problems are solved as follows. The heat-sensitive recording material is produced by comprising a support and the heat-sensitive color-developing layer of metal-chelate type containing an electron acceptor and an electron donor, said acceptor comprising a metal double salt of higher fatty acid having 16–35 carbon atoms.

DETAILED DESCRIPTION OF THE INVENTION

The kind of electron donor is not limited. However the preferred electron donor is at least one member selected from a group consisting of polyvalent hydroxyaromatic compounds, diphenylcarbide, diphenylcarbazone, hexamethylenetetramine, spirobenzopyran and 1-formyl-4-phenylsemicarbazid.

The heat-sensitive recording material is produced by coating on a support the coating color containing a combination of the above electron donor and a conventional electron acceptor.

The metal double salt of higher fatty acid used in this invention means a metal double salt having at least two metal atoms as higher fatty acid-metal in the molecule. Owing to the double salt, the metal double salt of higher fatty acid is clearly different in physical-chemical properties from a higher fatty acid metal salt (metal single salt) containing one metal atom. The metal double salt of higher fatty acid is synthesized by causing the reaction between alkali metal salt or ammonium salt of higher fatty acid and at least two inorganic metal salts. Hence, the kind and the mixing ratio of two metal atoms in double salt are unrestrictedly controlled in this synthesis. For example, iron-zinc double salt of behenic acid containing iron and zinc of a mixed ratio of 2:1 is obtained by causing a reaction between an aqueous solution of sodium behenate and an aqueous solution of ferric chloride and zinc chloride having a mixed ratio of 2:1.

Suitable metals in the metal double salt of higher fatty acid are iron, zinc, calcium, magnesium, aluminum, barium, lead, manganese, tin, nickel, cobalt, copper, silver, quicksilver, etc.; preferable metals are zinc, calcium, aluminum, magnesium and silver. In this invention, there are used metal double salt of higher fatty acid having saturated or unsaturated aliphatic group with 16–35 carbon atoms.

The electron donors of this invention used with the above metal double salt of higher fatty acid are polyvalent hydroxyaromatic compounds, diphenylcarbazide, diphenylcarbazone, hexamethylenetetramine, spirobenzopyran, 1-formyl-4-phenylsemicarbazide, etc.

Particularly, the polyvalent hydroxyaromatic compounds of the following general formula (I) are most preferred.

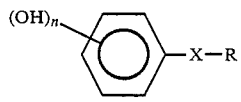

(I)

where R represents alkyl group having 18–35 carbon atoms,

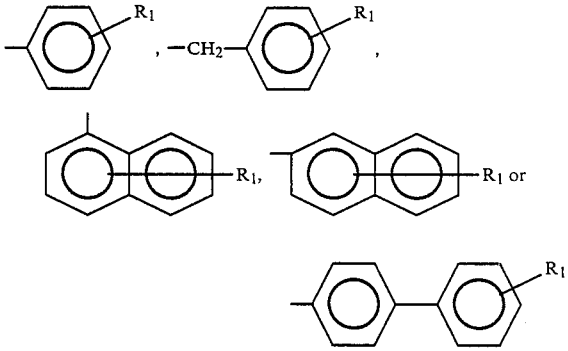

($R_1$ is an alkyl group having 18–35 carbon atoms); n represents an integer from 2 to 3, and —X— represents $$-CH_2-,\ -CO_2-,\ -CO-,\ -O-,\ -CONH-\ \text{or}\ -\underset{\underset{R'}{|}}{CON}-$$

(R′ is an alkyl group having 5–30 carbon atoms). The representative metal double salts of higher fatty acids include the following substances, but they are not limited to these substances.

(1) iron-zinc double salt of stearic acid
(2) iron-zinc double salt of montanic acid
(3) iron-zinc double salt of acid wax
(4) iron-zinc double salt of behenic acid
(5) iron-calcium double salt of behenic acid
(6) iron-aluminum double salt of behenic acid
(7) iron-magnesium double salt of behenic acid
(8) silver-calcium double salt of behenic acid
(9) silver-aluminum double salt of behenic acid
(10) silver-magnesium double salt of behenic acid
(11) calcium-aluminum double salt of behenic acid These metal double salts of higher fatty acids may be used alone as an electron acceptor of heat-sensitive recording sheet. It is possible to use two or more metal double salts of higher fatty acids, simultaneously.

The polyvalent phenolic derivatives used as electron donor in this invention are described as follows, but they are not limited to the following compounds, wherein R is an alkyl group having $C_{18}$–$C_{35}$, and R′ is an alkyl group having $C_5$–$C_{30}$.

(1)

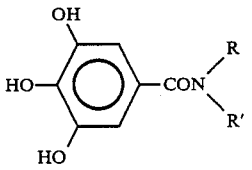

(2)

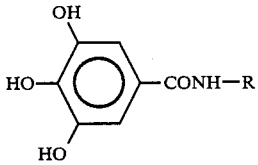

(3)

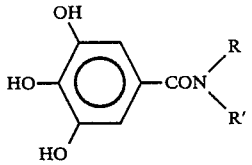

(4)

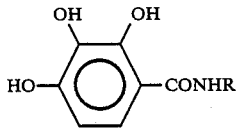

(5)

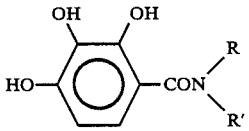

(6)

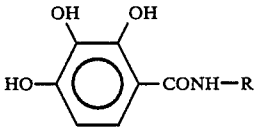

(7)

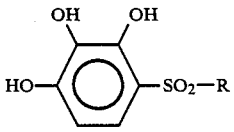

(8)

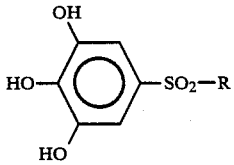

(9)

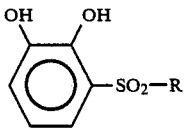

(10)

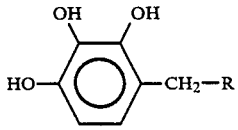

-continued (11)

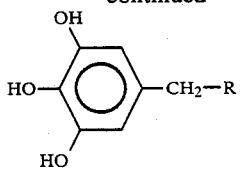

(12)

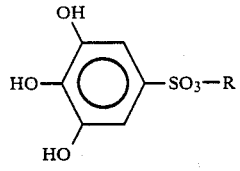

(13)

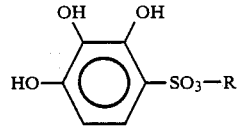

(14)

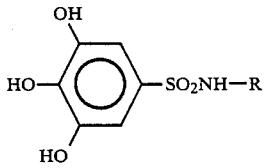

(15)

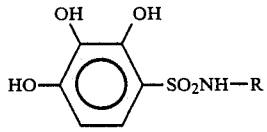

(16)

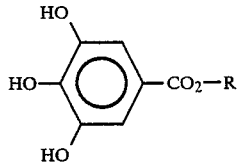

(17)

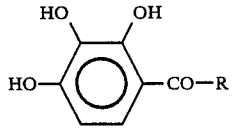

(18)

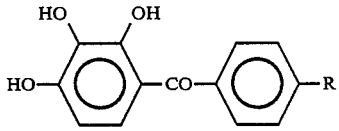

In preparing the coating by dispersing the above polyvalent phenolic derivative in water-system or solvent-system binder, it is required that these phenolic derivatives do not react with the electron-acceptor, and that the solvent-resistance and the dispersing stability of the phenolic derivatives are improved. In this invention, therefore, the substituent group other than the color forming group has a rare carbon number of 18 to 35. Further, it is preferable that the number of hydroxyl groups is 2 to 3 and the hydroxyl groups are adjacent to one another.

These polyvalent phenolic derivatives are used independently. It is possible to use two or more polyvalent phenols, if necessary.

It is possible to use phenols or organic acids together, in the range without deteriorating the effects, with the polyvalent phenolic derivative of this invention the phenols or organic acids being employed in a heat sensitive recording system in which leuco colorless dyes are used according to the use and performance of heat sensitive recording material. Examples of such phenols or organic acids include bisphenol A, p,p'-(1-methylnormalhexyliden) diphenol, p-tertiarybutylphenol, p-phenylphenol, p-hydroxybenzoate, novolak type phenol resin, 4-hydroxy-1-methyl sulfonyl benzene and 4-hydroxy-1-butyl oxysulfonyl benzene. However, the single use of an electron donar according to this invention is obviously superior to in resistance to the solvent such as alcohol or the like. Further, in this invention, anti-foggants (e.g. fatty acid amide, ethylene bisamide, montan wax), sensitizers (e.g. dibenzyl terephthalate, benzyl p-benzyloxybenzoate, di-p-trylcarbonate, p-benzylbiphenyl) and stabilizers (e.g. metal salts of phthalic acid monoester, metal salts of p-tertiary-butylbenzoate, metal salts of nitrobenzoic acid) may be contained in the heat sensitive coloring layer, whereby peculiar effects can be expected for the agents, respectively.

The colorless leuco dyestuffs may be used in this invention and are, for example, as follows.

Triphenylmethane leuco dyes 3,3-bis(p-dimethylaminophenyl)-6-dimethylaminophthalide (crystall violet lactone)

Fluoran leuco dyes 3-diethylamino-6-methyl-7-anilinofluoran
3-(N-ethyl-p-toluidino)-6-methyl-7-anilinofluoran
3-(N-ethyl-N-isoamyl)amino-6-methyl-7-anilinofluoran
3-diethylamino-6-methyl-7-(o,p-dimethylanilino)fluoran
3-pyrolidino-6-methyl-7-anilinofluoran
3-pyperidino-6-methyl-7-anilinofluoran
3-(N-cyclohexyl-N-methylamino)-6-methyl-7-anilinofluoran
3-pyperidino-6-methyl-7-anilinofluoran
3-(N-cyclohexyl-N-methylamino)-6-methyl-7-anilinofluoran
3-diethylamino-7-(m-trifluoromethylanilino)fluoran
3-dibutylamino-7-(o-chloroanilino)fluoran
3-diethylamino-6-methyl-chlorofluoran
3-diethylamino-6-methyl-fluoran
3-cyclohexylamino-6-chlorofluoran
3-diethylamino-7-(o-chloroanilino)fluoran
3-diethylamino-benzo[a]-fluoran Azaphthalide leuco dyes 3-(4-diethylamino-2-ethoxyphenyl)-3-(1-ethyl-2-methyl-indole-3-yl)-4-azaphthalide
3-(4-diethylamino-2-ethoxyphenyl)-3-(1-ethyl-2-methyl-indole-3-yl)-7-azaphthalide
3-(4-diethylamino-2-ethoxyphenyl)-3-(1-octyl-2-methyl-indole-3-yl)-4-azaphthalide
3-(4-N-cyclohexyl-N-methylamino-2-methoxyphenyl)-3-(1-ethyl-2-methylindole-3-yl)-4-azaphthalide Florene leuco dyes 3,6,6'-tris(dimethylamino)spiro[fluorene-9,3'-phthalide]
3,6,6'-tris(diethylamino)spiro[fluorene-9,3'-phthalide]

These dyestuffs may be used alone or in combination.

As the binders of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyral-modified polyvinyl alcohol, other modified polyvinyl alcohol, hydroxyethyl cellulose, methyl cellulose, carboxymethyl cellulose, stryrene/malic acid anhydride copolymers, styrene/butadiene copolymers, cellulose delivatives such as ethyl cellulose, acetyl cellulose, etc.; polyvinyl chloride, polyvinyl acetate, polyacryl amide, polyacrylic acid ester, polyvinyl butyrol, polystyrol and copolymers thereof; polyamide resin, silicone resin, petroleum resin, terpene resin, ketone resin and cumaron resin.

These polymeric materials may be used after they were dissolved in a solvent such as water, alcohol, ketone, ester hydrocarbon, etc., or after they were emulsified or dispersed in water or a solvent other than water.

The species and the amount of metal double salt of higher fatty acid, polvalent phenol derivative, binder, and other ingredients are determined depending upon the performance and recording apptitude required for the heat-sensitive recording material, and are not otherwise limited. However, in ordinary cases, it is suitable to use 1–6 parts by weight of electron donor and 2–15 parts by weight of filler, based on 1–9 parts by weight of metal double salt of higher fatty acid, and to add 0.5–4 parts by weight of a binder in total solid content.

The aimed heat-sensitive recording material may be obtained by coating the above coating color on a support such as paper, synthetic paper, film, etc.

The above metal double salt of higher fatty acid, the above electron donor, if necessary organic color-developing agent and basic colorless dyestuff are ground down to a particle size of several microns or smaller by means of a grinder or emulsifier such as a ballmill, attritor, sand grinder, etc. and binder and various additives in accordance with the purpose, are added thereto to prepare coating colors. The additives of this invention are, for example, inorganic or organic fillers such as silica, calcium carbonate, kaolin, calcined kaolin, diatomaceous earth, talc, titanium dioxide, aluminium hydroxide; releasing agent such as metal salts of fatty acids, etc.; slipping agent such as waxes, etc.; UV-absorbers such as benzophenone type or triazole type; water-resistance agent such as glyoxal, etc.; dispersant; anti-foamer, etc.

Function

The reason why the heat-sensitive recording material of this invention is superior in the dispersibility is explained as follows. Generally, metal salt of higher fatty acid has a function as interfacial active agent since this salt has both hydrophilic group and hydrophobic group in the molecule. Hence, when this salt is ground and dispersed to a particle size of several microns or smaller by means of a grinder or emulsifier such as a ball mill, attritor, sand grinder, etc., it has readily the defects in dispersing, that is, foam trouble, increased viscosity and coagulate forming. However, in the metal double salt of higher fatty acid containing at least two kinds of metals in the molecule, these metals act each other. Which causes particular surface active function so that the dispersibility is improved.

The reason why the heat-sensitive recording material of this invention is superior in the optical readability in the near infrared region is explained as follows. When there is formed a complex color-forming material obtained by a heat-melt reaction between a metal double salt of higher fatty acid as electron acceptor and an electron donor, e.g. polyvalent phenolic derivative, a colored image is obtained in visible light and in the light of the near infrared region (wave length range of 700–1000 nm).

The reason why the recorded image of a heat-sensitive material of this invention is superior in oil resistance and solvent resistance is considered to be due to irreversible heat-melt (color-forming) reaction between a metal double salt of higher fatty acid as electron acceptor and an electron donor, e.g. polyvalent phenolic derivative. That is, a complex produced by a heat-melt (color-forming) reaction is so stable, that the chemical bonding is never cut even with the adhesion of hair oil, fats, oils and organic solvent such as alcohols. Meanwhile, the reason why the background of the heat-sensitive recording material is superior in oil resistance and solvent resistance is considered as follows. That is, the metal double salt of higher fatty acid of this invention contains in the molecule thereof an alkyl group having a carbon number of 16 to 35. Hence, they are very small solubility to organic solvents, such as hair oil, oils, fatts and alcohols. Therefore, even in the contact with a contaminated substance, the chemical reaction between a metal double salt of higher fatty acid and an electron donor, e.g. phenolic derivative, does not take place.

Further, the reason for a superior image contrast is as follows. Generally, metal salts of higher fatty acids have various colors from colorless salt to colored salt depending upon the metal properties. For example, iron salt of higher fatty acid has paled yellow color, while zinc salt thereof is colorless. Consequently, iton-zinc double salt of higher fatty acid, in which iron and zinc are introduced in a molecule, is slightly colored. Hence, there is provided a slightly colored background in a heat-sensitive recording sheet obtained by dispersing this double salt and coating the dispersed substance. Thus, through such appropriate combination of at least two kinds of metals, it is possible to provide a heat-sensitive recording sheet having little colored background.

Examples

This invention will be described by way of examples hereunder. Throughout the specification the parts are units by weight.

[Examples (Test Nos. 1–4)]

| | |
|---|---|
| Solution A (dispersion of electron acceptor) | |
| metal double salt of higher fatty acid (see TABLE 1) | 4.0 parts |
| 10% aqueous solution of polyvinyl alcohol | 10.0 parts |
| water | 6.0 parts |
| Solution B (dispersion of electron donor) | |
| polyvalent phenolic derivative (See TABLE 1) | 4.0 parts |

-continued

| | |
|---|---|
| zinc stearate | 1.5 parts |
| 10% aqueous solution of polyvinyl alcohol | 13.75 parts |
| water | 8.25 parts |

The solutions A and B of the above-mentioned composition were individually ground to a particle size of 3 microns by attritor. Then, the dispersions were mixed in the following portion to prepare the coating color.

| Coating Color | |
|---|---|
| Solution A | 20.0 parts |
| Solution B | 36.5 parts |
| Kaolin clay (50% aqueous dispersion) | 12.0 parts |

The coating color was applied on one side of a base paper weighing 50 g/m$^2$ at a coating weight of 6.0 g/m$^2$ and was then dried. The resultant paper was treated to a smoothness of 200–600 seconds by a supercalender. In this manner, a heat-sensitive recording sheet was obtained.

[Comparative Examples (Test Nos. 5 - 8)]

| | |
|---|---|
| Solution A (dispersion of electron acceptor) | |
| highly fatty acid metal salt (see Table 1) | 4.0 parts |
| 10% aqueous solution of polyvinyl alcohol | 10.0 parts |
| water | 6.0 parts |
| Solution B (dispersion of electron donor) | |
| polyvalent phenolic derivative (see TABLE 1) | 4.0 parts |
| zinc stearate | 1.5 parts |
| 10% aqueous solution of polyvinyl alcohol | 13.75 parts |
| water | 8.25 parts |

The solutions A and B of the above-mentioned composition were individually ground to a particle size of 3 microns by attritor. Then, the dispersions were mixed in the same portion as in Example to prepare the coating color.

The coating color was applied on one side of a base paper weighing 50 g/m$^2$ at a coating weight of 6.0 g/m$^2$ and was dried. The resultant paper was treated to a smoothness of 200–600 seconds by a supercalender.

In this manner, a heat-sensitive recording sheet was obtained.

The heat-sensitive recording sheets obtained in Examples and Comparative Examples were tested for the following articles. The test results were shown in Tables 1 and 2.

TABLE 1

| | | | Test Results | | | | | | |
|---|---|---|---|---|---|---|---|---|---|
| | | | | | Coloration of | Oil resistance (4) | | | |
| Test No. | Electron acceptor | Electron donor | Image density (1) | Back ground (2) | back-ground (3) | Before oil treatment | After oil treatment | Percent residue (%) | Infrared reflectance (%) (5) |
| Examples | | | | | | | | | |
| 1 | Fe.Zn double salt of behenic acid (2:1)* | 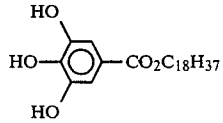 | 1.01 | 0.05 | little | 1.01 | 1.01 | 100 | 15 |

TABLE 1-continued

| Test No. | Electron acceptor | Electron donor | Test Results: Image density (1) | Back ground (2) | Coloration of background (3) | Oil resistance (4): Before oil treatment | After oil treatment | Percent residue (%) | Infrared reflectance (%) (5) |
|---|---|---|---|---|---|---|---|---|---|
| 2 | Fe.Ca double salt of behenic acid (2:1) | 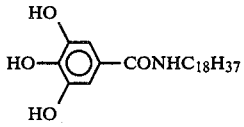 | 0.99 | 0.05 | little | 0.99 | 0.99 | 100 | 17 |
| 3 | Ag.Al double salt of stearic acid (2:1) | 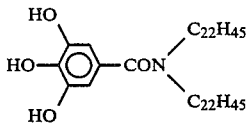 | 1.00 | 0.05 | little | 1.00 | 1.00 | 100 | 16 |
| 4 | Ag.Mg double salt of stearic acid (2:1) | 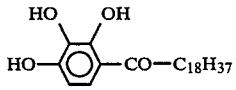 | 0.98 | 0.05 | little | 0.99 | 0.99 | 100 | 17 |
| Comparative Examples | | | | | | | | | |
| 5 | Fe-Behenate | 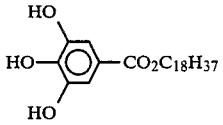 | 0.97 | 0.06 | some | 0.96 | 0.96 | 100 | 31 |
| 6 | Ag-Stearate | 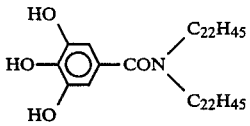 | 0.82 | 0.07 | some | 0.80 | 0.79 | 99 | 32 |
| 7 | Fe-Behenate | 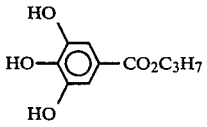 | 0.45 | 0.20 | intense | 0.47 | 0.42 | 89 | 58 |
| 8 | Ag-Stearate | 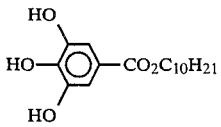 | 0.66 | 0.19 | intense | 0.64 | 0.59 | 92 | 48 |

*(2:1) means a mol-ratio of two metals in metal double salt of higher fatty acid.

TABLE 2

| Test No. | Electron acceptor | Elector donor | Test Results: Dispersibility (6): Viscosity (CPS) | Coagulate* | Foam* | Solvent resistance (Background) (7): Before solvent treatment | After solvent treatment | Image density difference | Solvent resistance (Recorded portion) (8): Before solvent treatment | After solvent treatment | Percent residue (%) |
|---|---|---|---|---|---|---|---|---|---|---|---|
| Examples | | | | | | | | | | | |
| 1 | Fe.Zn double salt of behenic acid (2:1) | 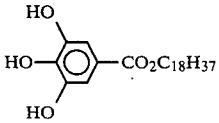 | 115 | no | no | 0.05 | 0.08 | 0.03 | 1.01 | 1.00 | 99 |

TABLE 2-continued

| Test No. | Electron acceptor | Elector donor | Test Results: Dispersibility (6) Viscosity (CPS) | Coagulate* | Foam* | Solvent resistance (Background) (7) Before solvent treatment | After solvent treatment | Image density difference | Solvent resistance (Recorded portion) (8) Before solvent treatment | After solvent treatment | Percent residue (%) |
|---|---|---|---|---|---|---|---|---|---|---|---|
| 2 | Fe.Ca double salt of behenic acid (2:1) | 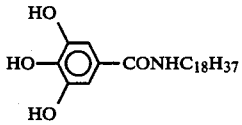 | 120 | no | no | 0.05 | 0.07 | 0.02 | 0.98 | 0.98 | 100 |
| 3 | Ag.Al double salt of stearic acid (2:1) | 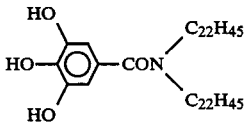 | 114 | no | no | 0.05 | 0.08 | 0.03 | 1.01 | 1.00 | 99 |
| 4 | Ag.Mg double salt of stearic acid (2:1) | 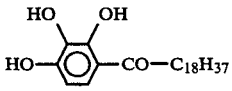 | 119 | no | no | 0.05 | 0.08 | 0.03 | 1.00 | 0.99 | 99 |
| Comparative Examples | | | | | | | | | | | |
| 5 | Fe-Behenate | 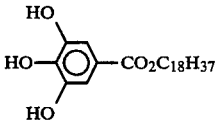 | 1050 | many | many | 0.06 | 0.09 | 0.03 | 0.96 | 0.95 | 99 |
| 6 | Ag-Stearate | 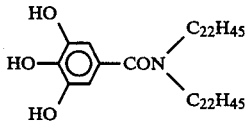 | 865 | some | many | 0.07 | 0.11 | 0.04 | 0.82 | 0.79 | 96 |
| 7 | Fe-Behenate | 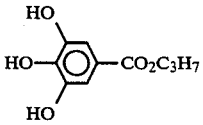 | 1050 | many | many | 0.20 | 0.31 | 0.11 | 0.44 | 0.12 | 27 |
| 8 | Ag-Stearate | 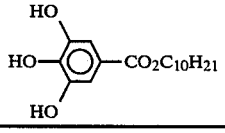 | 865 | some | many | 0.19 | 0.27 | 0.08 | 0.65 | 0.20 | 31 |

Note (1) Image density : A heat-sensitive recording sheet was recorded in a pulse width of 3.2 milliseconds and an impressed voltage of 18.03 volts by using the thermal facsimile KB-4800 manufactured by TOSHIBA CORPORATION and the optical density of the recorded image was measured by a Macbeth densitometer. (using RD-514 and amber filter, the same in the following)

(2) Background : Unrecorded portion was measured by a Macbeth densitometer.

(3) Coloration of the background : The coloration of the background was observed and rated as follows: little; some; and intense.

(4) Oil resistance : The density of an image recorded on a heat-sensitive recording sheet by a thermosensitive facsimile (KB-4800 manufactured by TOSHIBA CORPORATION) with an impressed voltage of 18.03 volt and a pulse width of 3.2 milliseconds was measured by the Macbeth densitometer. This density is termed as the density of the untreated image. Caster oil was applied dropwise to the recorded colored part, and lightly wiped off with filter paper. After standing for 3 days at room temperature, the density of the recorded image was measured by the Macbeth densitometer, and the percent residue was calculated in accordance with the following equation.

Percent residue =

-continued $$\frac{\text{Optical density after oil treatment}}{\text{Optical density before oil treatment}}$$

(5) Infrared reflectance (%) : The infrared reflectance of the image portion recorded by the method of Note (1) was measured by a spectrophotometer (wavelength : 800 nm)

(6) Dispersibility : The dispersed solution A of metal salt of higher fatty acid was tested. The viscosity was measured by using B-type viscosimeter (manufactured by Tokyo Keiki Co.). The coagulation was observed by a microscope, and the foam was observed with the eye. The test results were rated as follows: no; some; and many.

(7) Solvent resistance (Background) : 95% ethyl alcohol solution was dropped on an unrecorded portion. After 30 minutes, the optical density was measured by a Macbeth densitometer. An image density difference is calculated by the following equation.

Image density difference=[image density of the background after solvent treatment] - [image density of the background before solvent treatment]

(8) Solvent resistance (Recorded portion) : The image portion recorded by the method of Note (1) was impregnated in 95% ethyl alcohol solution for 30 minutes, and then measured by a Macbeth densitometer. Percent residue is calculated by the following equation.

Percent residue =

$$\frac{\text{Image density after solvent treatment}}{\text{Image density before solvent treatment}} \times 100\ (\%)$$

The effect of the invention

This invention provides following effects:

(1) superior dispersibility, (2) better image contrast, (3) better readability in the near infrared region (4) stable image and ground color against oily substance such as hair oil, sebum, etc., and (5) better brightness of the background, and no flowing-out of the color-developing layer, even in the contamination with organic solvent, such as alcohols, acetones, etc.

We claim:

1. A heat-sensitive recording material comprising a support sheet having a heat-sensitive color-developing layer of metal-chelate type containing an electron acceptor and an electron donor, said acceptor comprising a metal double salt of higher fatty acid having 16–35 carbon atoms.

2. The heat-sensitive recording material according to claim 1, wherein said metal double salt of higher fatty acid comprises at least two metals selected from a group consisting of iron, calcium, magnesium, aluminum, barium, lead, manganese, tin, nickel, cobalt, copper, silver and quicksilver.

3. The heat-sensitive recording material according to claim 1 or 2, wherein said electron donor is at least one member selected from a group consisting of polyvalent hydroxyaromatic compound, diphenylcarbazide, diphenylcarbazone, hexamethylenetetramine, spirobenzopyran, and 1-formyl-4-phenylsemicarbazide.

4. The heat-sensitive recording material according to claim 3, wherein said donor is a polyvalent hydroxyaromatic compound represented by the following general formula (I):

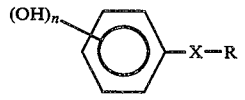

(I)

where R represents alkyl group having 18–35 carbon atoms,

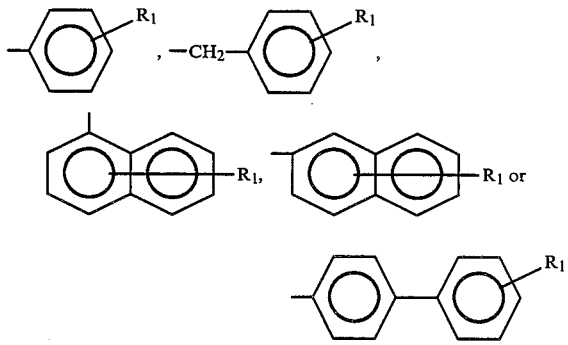

($R_1$ is an alkyl group having 18–35 carbon atoms); n represents an integer from 2 to 3, and —X— represents $$-CH_2-,\ -CO_2-,\ -CO-,\ -O-,\ -CONH-\ \text{or}\ -\underset{\underset{R'}{|}}{CON}-$$

(R′ is an alkyl group having 5–30 carbon atoms).

5. The heat-sensitive recording material according to claim 1 or 2, wherein said metal double salt of higher fatty acid comprises at least one number selected from a group consisting of iron-zinc double salt of stearic acid, iron-zinc double salt of montanic acid, iron-zinc double salt of acid wax, iron-zinc double salt of behenic acid, iron-calcium double salt of behenic acid iron-aluminum double salt of behenic acid, iron-magnesium double salt of behenic acid, silver-calcium double salt of behenic acid, silver-aluminum double salt of behenic acid, silver-magnesium double salt of behenic acid and calcium-aluminum double salt of behenic acid.

6. The heat-sensitive recording material according to claim 1, wherein said color-developing layer comprises 1–6 parts by weight of electron donor and 2–15 parts by weight filler, based on 1–9 parts by weight of metal double salt of higher fatty acid, and 0.5–4 parts by weight of binder in total solid content.

7. The heat-sensitive recording material according to claim 1, wherein said color-developing layer lies on the support.

8. The heat-sensitive recording material according to claim 7, wherein said support is at least one member selected from a group consisting of paper, synthetic paper and film.

* * * * *

UNITED STATES PATENT AND TRADEMARK OFFICE

CERTIFICATE OF CORRECTION

PATENT NO. : 4,849,396

DATED : July 18, 1989

INVENTOR(S) : Toshimi Satake, et al

It is certified that error appears in the above-identified patent and that said Letters Patent is hereby corrected as shown below: On the title page:

Column [30] Foreign Application Priority Data:

Change "Mar. 6, 1986[JP] Japan .... 61-128691"

to --June 3, 1986 [JP] Japan .... 61-128691--

Signed and Sealed this

Twenty-second Day of May, 1990

*Attest:*

HARRY F. MANBECK, JR.

*Attesting Officer*

*Commissioner of Patents and Trademarks*